US005689098A

United States Patent [19]

Gillieron

[11] Patent Number: 5,689,098

[45] Date of Patent: Nov. 18, 1997

[54] POSTAGE METER WITH IMPROVED POSTAL LOCK

[75] Inventor: Christian Gillieron, Fraubrunnen, Switzerland

[73] Assignee: Ascom Hasler Mailing Systems AG, Bern, Switzerland

[21] Appl. No.: 451,511

[22] Filed: May 26, 1995

[51] Int. Cl.[6] ..... G07G 1/00

[52] U.S. Cl. ..... 235/101; 235/110; 235/130 R; 235/131 R; 292/32 C; 364/464.02

[58] Field of Search ..... 235/110, 130 R, 235/131 R, 101; 101/91; 292/32 C; 364/464.02

[56] References Cited

U.S. PATENT DOCUMENTS

| | | | |
|---|---|---|---|
| Re. 31,875 | 4/1985 | Check, Jr. et al. | 364/900 |
| 3,938,055 | 2/1976 | Buhler | 330/30 D |
| 3,978,457 | 8/1976 | Check, Jr. et al. | 340/172.5 |
| 4,180,856 | 12/1979 | Check, Jr. et al. | 364/466 |
| 4,202,489 | 5/1980 | Schubert | 235/101 |
| 4,246,643 | 1/1981 | Hubbard | 364/900 |
| 4,271,481 | 6/1981 | Check, Jr. et al. | 364/900 |
| 4,340,809 | 7/1982 | Betcher | 235/101 |
| 4,484,307 | 11/1984 | Quatse | 364/900 |
| 4,507,744 | 3/1985 | McFiggans et al. | 364/708 |
| 4,509,780 | 4/1985 | Erwin | 101/91 |
| 4,636,975 | 1/1987 | Soderberg | 364/900 |
| 4,639,581 | 1/1987 | Berger et al. | 235/101 |
| 4,650,973 | 3/1987 | Pike | 235/1 D |
| 4,675,841 | 6/1987 | Check, Jr. et al. | 364/900 |
| 4,730,821 | 3/1988 | Flückiger | 270/58 |
| 4,807,139 | 2/1989 | Liechti | 364/464.02 |
| 4,887,807 | 12/1989 | Berger et al. | 271/171 |
| 4,985,613 | 1/1991 | Lytra et al. | 235/101 |
| 5,038,153 | 8/1991 | Liechti et al. | 364/140 |
| 5,060,821 | 10/1991 | Berger et al. | 221/190 |
| 5,093,560 | 3/1992 | Abellana | 235/101 |
| 5,203,263 | 4/1993 | Berger et al. | 101/76 |
| 5,237,506 | 8/1993 | Horbal et al. | 364/464.02 |
| 5,276,844 | 1/1994 | Aebi et al. | 395/425 |
| 5,278,541 | 1/1994 | Wicht et al. | 340/636 |
| 5,301,116 | 4/1994 | Grünig | 364/464.02 |
| 5,340,965 | 8/1994 | Horbal et al. | 235/101 |
| 5,359,273 | 10/1994 | Flückiger | 318/794 |
| 5,363,760 | 11/1994 | Lindenmuller et al. | 101/91 |
| 5,389,863 | 2/1995 | Flückiger | 318/549 |

FOREIGN PATENT DOCUMENTS

| | | |
|---|---|---|
| 0062376 | 10/1982 | European Pat. Off. . |
| 0526139 | 2/1993 | European Pat. Off. . |
| 0526140 | 2/1993 | European Pat. Off. . |
| WO89/11134 | 11/1989 | WIPO . |

*Primary Examiner*—Cassandra C. Spyrou
*Attorney, Agent, or Firm*—Oppedahl & Larson

[57] ABSTRACT

A postage meter has a secure housing and a printing means and accounting register within the secure housing. Formed in the secure housing is postal lock. In the postal lock, a door is movable between first and second positions relative to a cavity. When the door is closed (in its first position) it renders the cavity inaccessible, and when the door is open (in its second position) it renders the cavity accessible. The door has a latch. The latch is spring-loaded so that it engages a latch feature in the cavity and holds the door closed. Pushing the latch the other way (against the spring) causes the latch to engage a pawl in the cavity, and the pawl tends to push the door open. A protruberance on the rear of the door engages a locking gear in the cavity. The locking gear allows separation of two halves of the meter housing, or holds the two halves together. If the locking gear is in the position that permits separating the halves, then the door cannot be closed because the gear abuts with the protruberance. Only if the gear is in the locked position is it possible to close the door fully. The door is set up to accommodate postal regulations of many countries, including countries requiring a key and lead seal, a paper seal, a lead seal by itself, or a lead seal and paper seal.

5 Claims, 13 Drawing Sheets

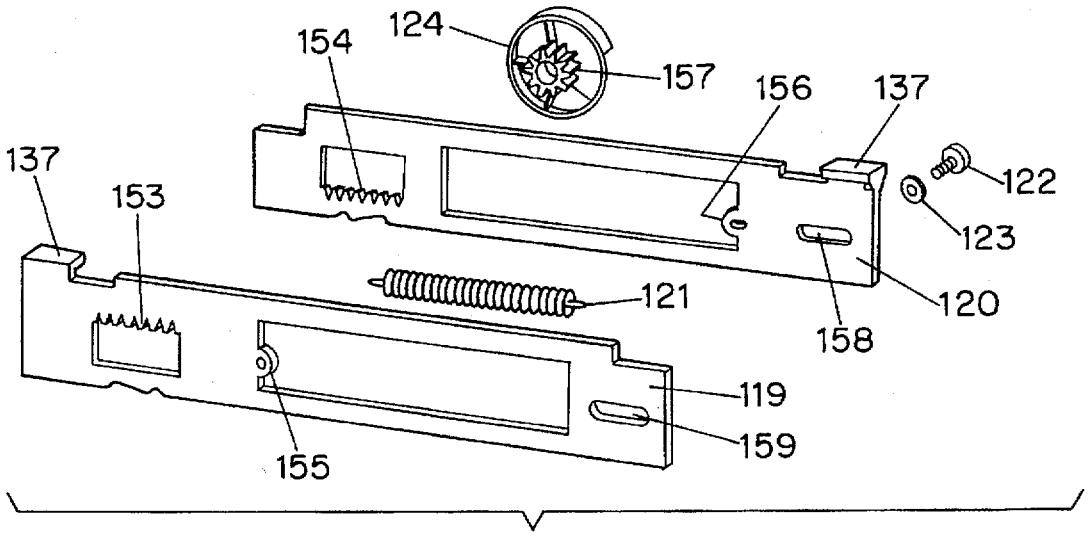
FIG. 8
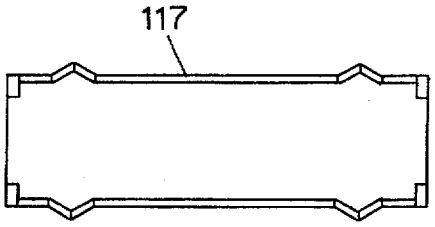
FIG. 9
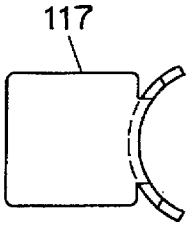
FIG. 10
FIG. 11
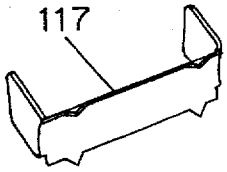
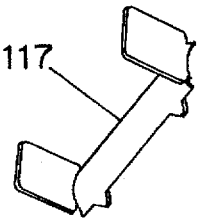
FIG. 12
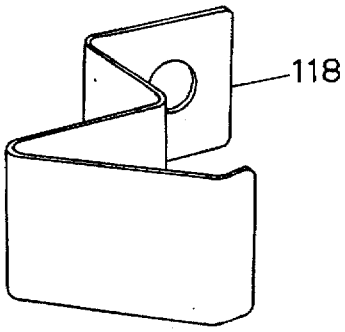
FIG. 13
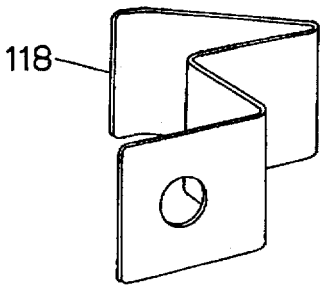
FIG. 14

POSTAGE METER WITH IMPROVED POSTAL LOCK

SPECIFICATION

The invention relates generally to postal locks for postage meters, and relates specifically to a versatile, reliable postal lock for a postage meter, capable of use in many countries of the world.

BACKGROUND OF THE INVENTION

Before a new model of postage meter (also called franking machine) can be entered into service, it has to be approved by the postal authorities. This has to be accomplished not once, but many times, before the postal authorities in each of the many countries where the meter is to be used. This means that when a postage meter is being designed, the design needs to take into account all of the varied (and sometimes conflicting) requirements of the postal authorities in those countries.

Among the most fundamental requirements for postal approval of a meter is that the meter house its printing means and its accounting registers in a secure housing. The printing means is typically a print rotor which rotates to print postage value on mail pieces. The accounting registers are typically ascending and/or descending registers, provided in nonvolatile random access memories (RAMs). The "secure housing" requirement is not interpreted to mean secure in the way that a safe is secure, but secure in the sense that if a would be wrongdoer tries to open the housing (or succeeds in opening it) then the meter will give clear visual evidence of the wrongdoing.

In some countries the postal lock has to be a lock actuated by a key, with a sliding metal cover over the key hole, and a lead seal holding the metal cover over the key hole.

In other countries the postal lock has to be a lead seal that prevents opening the case, but with no requirement of a lock and key.

In still other countries the postal lock has to be covered with a paper seal that is broken to open the meter; when the meter is taken to a post office for refilling (resetting) one of the important steps is to inspect the paper seal to be sure it is intact.

In yet other countries the postal lock has to be covered with a paper seal that is in turn covered with a clear plastic cover; to open the lock the plastic cover and paper seal are both pierced.

In some past designs of postage meters, this diversity of security requirements across many countries has led to different case designs and lock designs for the various countries. This is uneconomical since it increases the range of parts that must be kept in inventory. A related result is that once a meter is assembled sufficiently to be sent to a particular country it is mechanically wasteful to disassemble much of the meter to make it possible to change the case and lock to permit sending the meter to a different country.

Those skilled in the art have devoted much energy to attempting to arrive at postal lock designs that permit a lock to be used with minimal changes across all the countries for which postal approval is sought. But many such proposed designs have proven to be bulky or have had a large parts count. Other designs have proven to be difficult to open or difficult to close.

It is thus highly desirable to provide a postal lock that is usable across many countries, that is not unduly bulky, that has a relatively small parts count, and that is not difficult to open or close.

SUMMARY OF THE INVENTION

A postage meter has a secure housing and a printing means and accounting register within the secure housing. Formed in the secure housing is postal lock. In the postal lock, a door is movable between first and second positions relative to a cavity. When the door is closed (in its first position) it renders the cavity inaccessible, and when the door is open (in its second position) it renders the cavity accessible. The door has a latch. The latch is spring-loaded so that it engages a latch feature in the cavity and holds the door closed. Pushing the latch the other way (against the spring) causes the latch to engage a pawl in the cavity, and the pawl tends to push the door open. A protruberance on the rear of the door engages a locking gear in the cavity. The locking gear allows separation of two halves of the meter housing, or holds the two halves together. If the locking gear is in the position that permits separating the halves, then the door cannot be closed because the gear abuts with the protruberance. Only if the gear is in the locked position is it possible to close the door fully. The door is set up to accommodate postal regulations of many countries, including countries requiring a key and lead seal, a paper seal, a lead seal by itself, or a lead seal and paper seal.

DESCRIPTION OF THE DRAWING

The invention will be described with respect to a drawing in several figures, of which:

FIG. 8 is a perspective view of locking wedges holding a postage meter cover in place;

FIGS. 9, 10, 11, and 12 show front, side, and first and second perspective views, respectively, of a ferrule;

FIGS. 13, and 14 are perspective views of a retaining spring;

DETAILED DESCRIPTION

The invention relates to a postal lock of a postage meter. The discussion that follows describes in some detail several embodiments of the invention, with particular attention to the postal lock portions of the postage meter. Other aspects of design of a postage meter may be found in copending U.S. application Ser. No. 08/403,461 entitled Postage Meter With Improved Paper Path, assigned to the same assignee as the assignee of the present application, and incorporated herein by reference; in copending patent application entitled Protection System for Critical Memory Information, application Ser. No. 08/422,435, filed Apr. 14, 1995, and assigned to the same assignee as that of the present application, which is incorporated herein by reference; in a copending patent application entitled Single Motor Setting And Printing Postage Meter, application Ser. No. 08/422,155, filed Apr. 14, 1995, and assigned to the same assignee as that of the present application, which is incorporated herein by reference; in a copending patent application entitled System For Setting Date Wheels In A Postage Meter, application Ser. No. 08/421,902, filed Apr. 14, 1995, and assigned to the same assignee as that of the present application, which is incorporated herein by reference; in a copending patent application entitled Postage Meter With Hollow Rotor Axle, application Ser. No. 08/421,900, filed Apr. 14, 1995, and assigned to the same assignee as that of the present application, which is incorporated herein by reference; in a copending patent application entitled Postage Meter with Rotor Movement and Die Cover Sensor, application Ser. No. 08/446,218, filed May 22, 1995, and assigned to the same assignee as that of the present application, which is incorporated herein by reference; and in a copending application entitled Postage Meter with Improved Handling of Power Failure, application Ser. No. 08/450,129, filed May 25, 1995, and assigned to the same assignee as that of the present invention, which is incorporated herein by reference.

Figure 1:
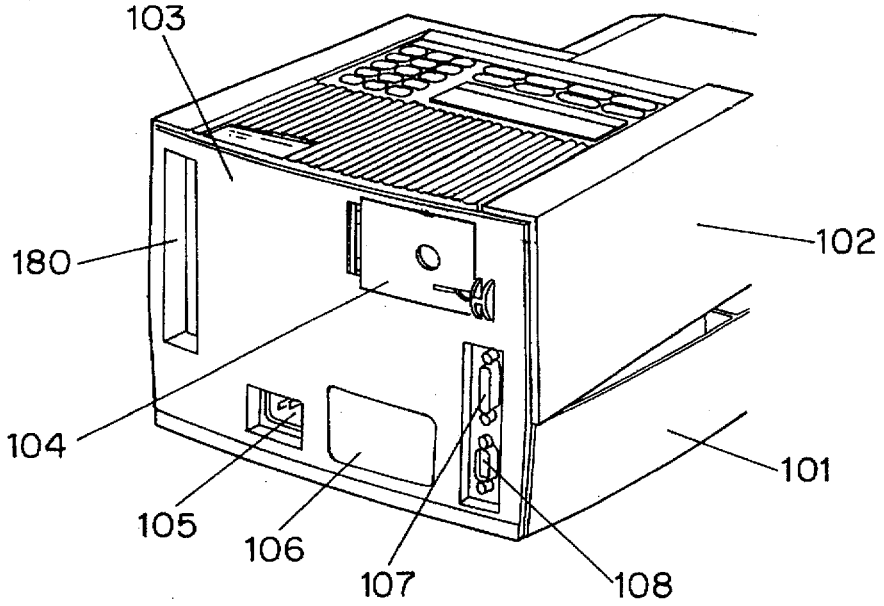
FIGS. 1 and 2 are perspective rear views of a typical postage meter.
Figure 2:
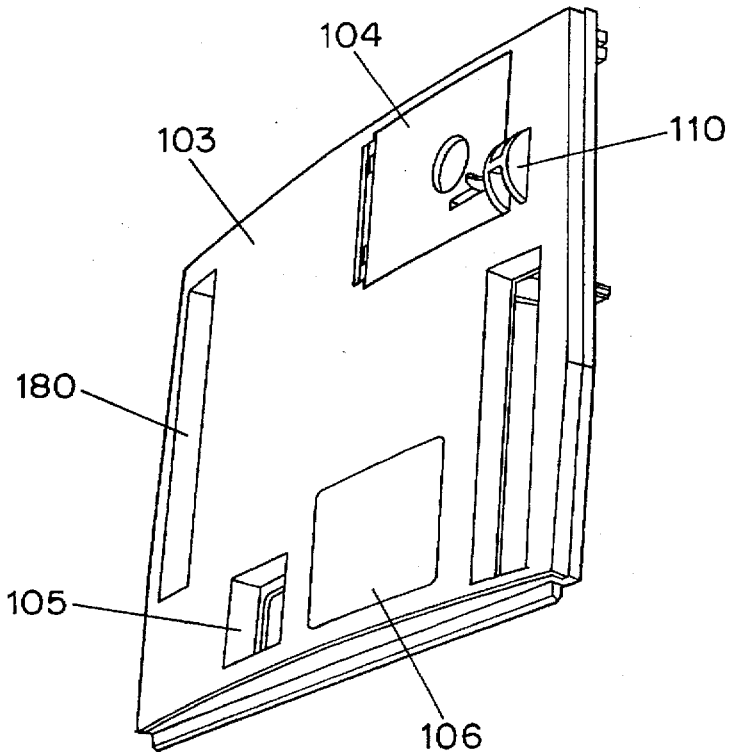

Turning now to FIGS. 1 and 2, what is shown are rear views of a postage meter. Top housing 102 and bottom housing 101, together with rear panel 103, comprise the secure housing of the postage meter. Bottom housing 101 and rear panel 103 are secured to each other internally to the meter. Opening 105 provides a receptacle for the power cord. Opening 180 provides access to a modem or other adaptor card. Legend plate area 106 receives a model number and serial number (legend) plate. RS-232 serial port 108 and RS-422 serial port 107 permit communications with external devices such as scales and computers. Postal lock door 104 may be seen, as well as tie point 110 for a lead seal if used.

Figure 3:
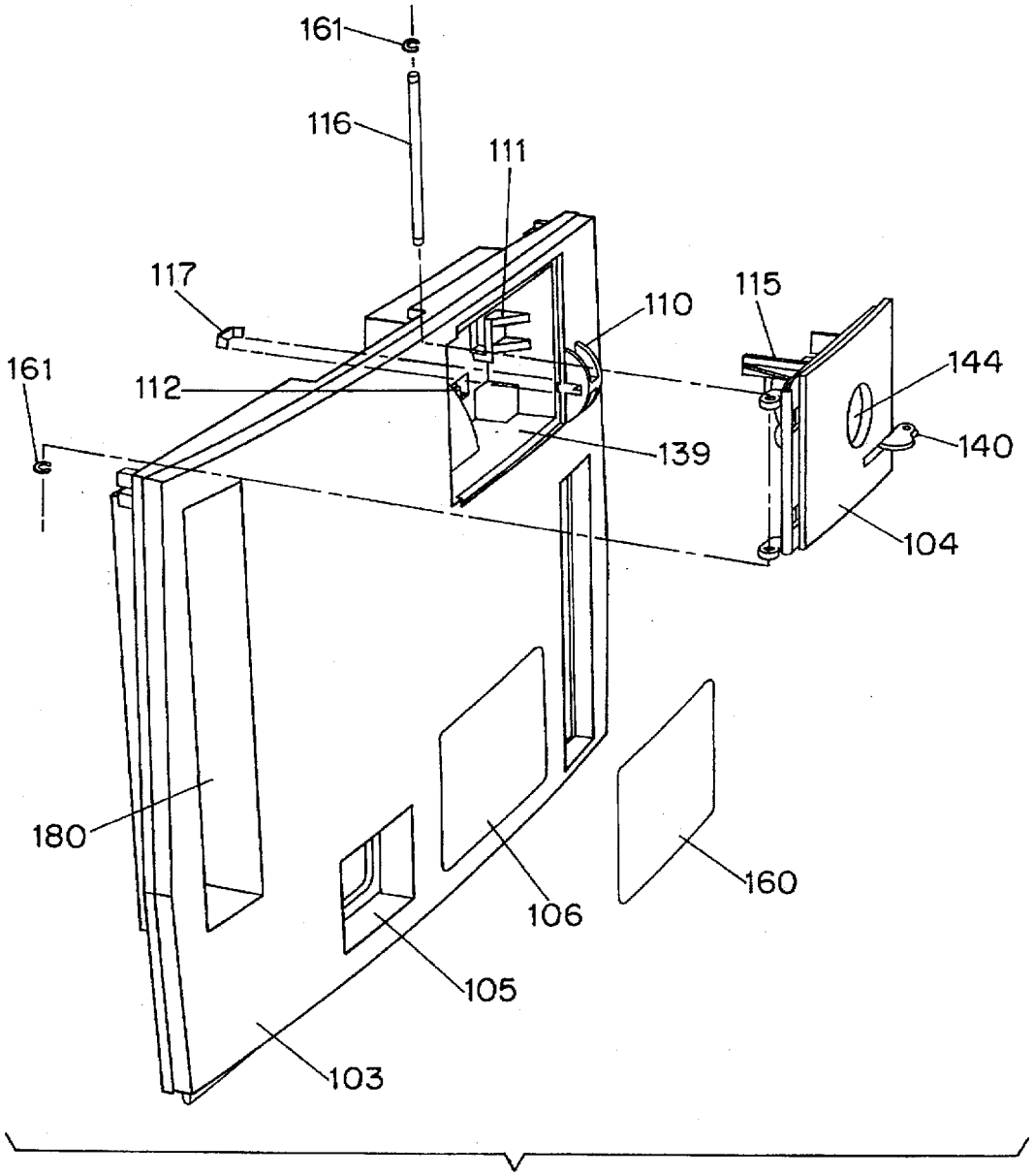
FIG. 3 is an exploded rear view of a typical postage meter.

Turning now to FIG. 3, the rear panel 103 is seen in exploded view. Legend plate 160 is seen juxtaposed with legend plate area 106. Postal door 104 is visible, hinged to the rear panel 103 by pin 116. Pin 116 is in turn captivated by circlips 161. Ferrule 117 fits inside a horizontal opening in the tie point 110. Metal tongue 140 is visible, which is slidable into the horizontal opening in the tie point 110. Some features of door 104 are visible including round opening 144 and a protuberance 115 which projects from the rear of the door 104. The door 104 swings open and shut to cover cavity 139. Some features of cavity 139 are visible, including a latch feature 111 and a springy ratchet pawl 112.

Figure 4:
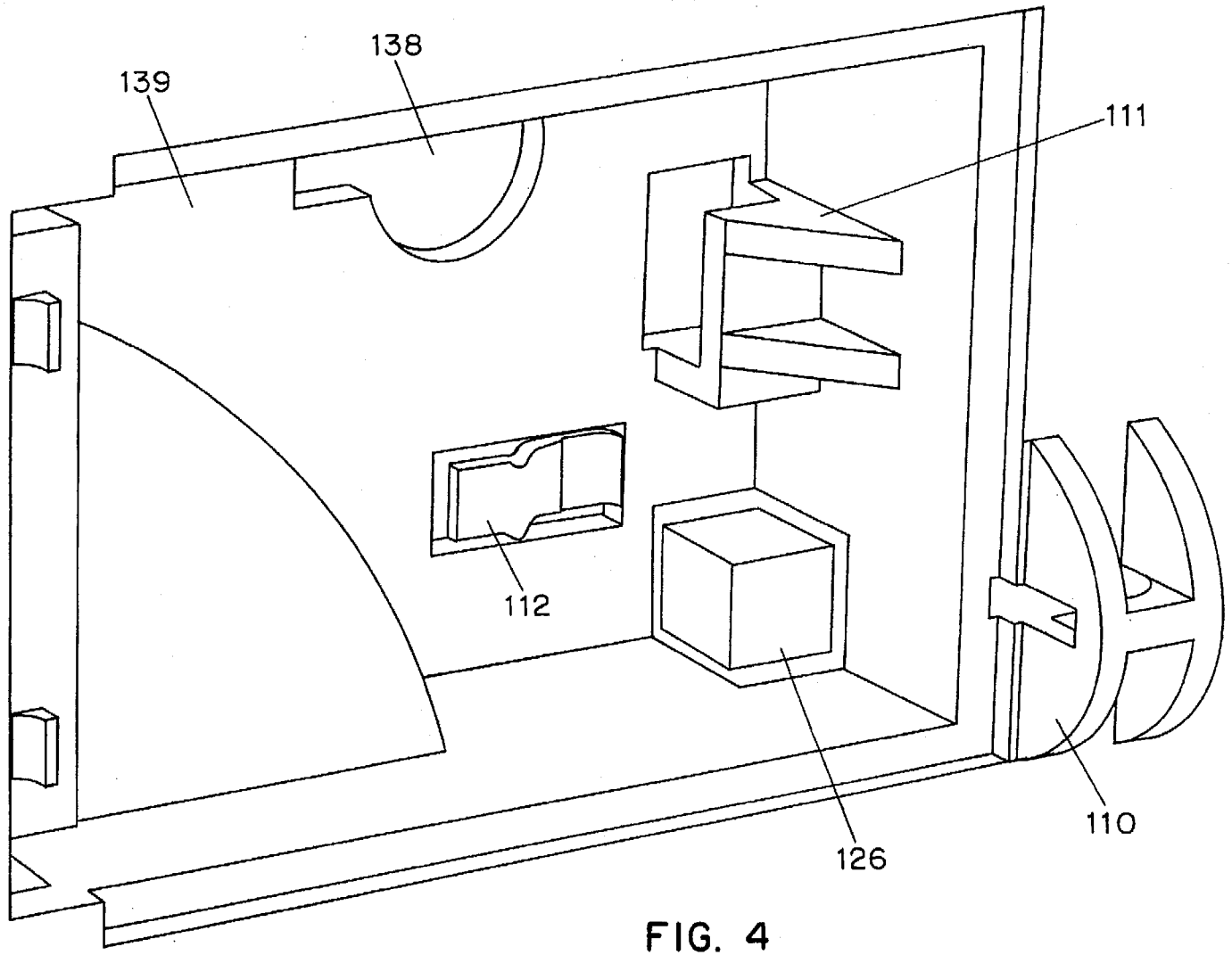
FIG. 4 is a perspective view of a postal lock cavity.
Figure 5:
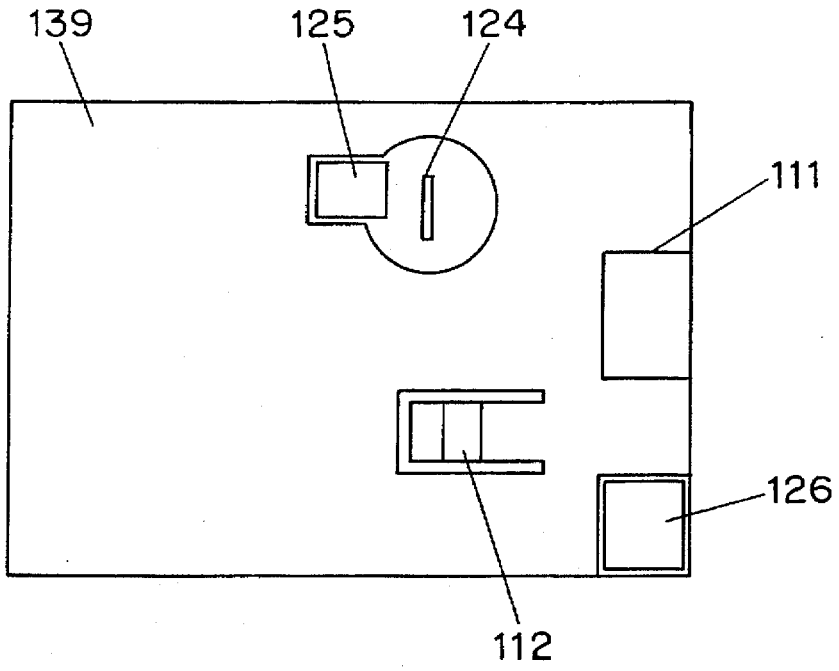
FIGS. 5 and 6 are plan views of a postal lock cavity.
Figure 6:
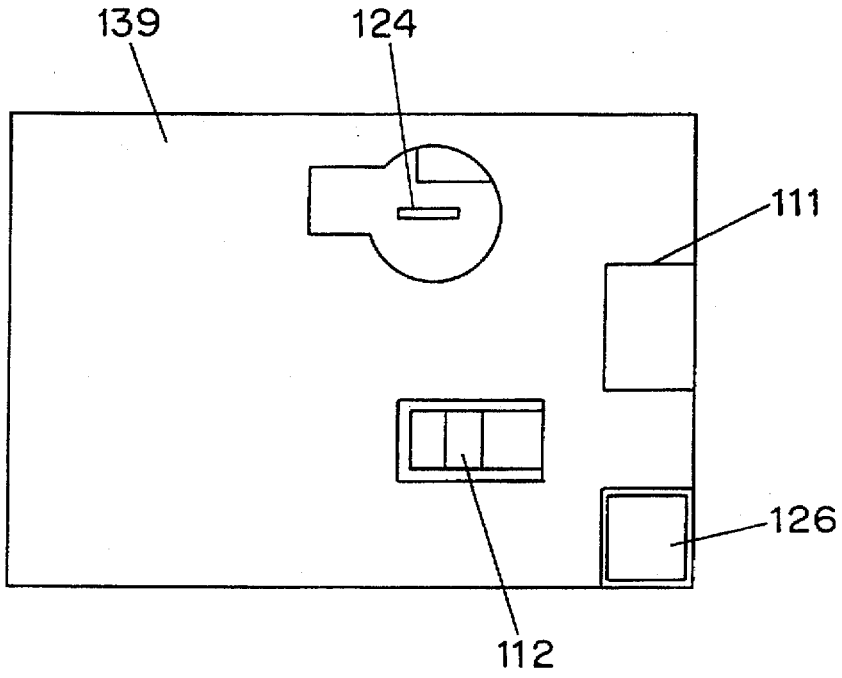

Turning now to FIG. 4, the postal lock cavity 139 is shown in greater detail. Tie point 110 is outside the cavity, formed into the rear panel 103. Latch feature 111 is visible, with a tapered front. The space behind the latch feature 111 is open to the left (in FIG. 4) and to the top, to accommodate latches that are released, as described below, either by rotation upwards or by sliding to the left. Springy pawl feature 112 may be seen, which is preferably integrally formed with the rear panel 103. Opening 138 is provided to permit access to a cover locking/unlocking gear omitted for clarity in FIG. 4. An opening is provided so that when the door is open, it is possible to depress postal switch 126, which provides an electrical signal to the processor of the postage meter to enable various software functions that are not available to the customer but only to postal authorities. The cavity 139 is shown in plan view in FIGS. 5 and 6. Gear 124 may be seen, in the locked position in FIG. 5 and in the unlocked position in FIG. 6. When the gear 124 is in the locked position (FIG. 5), a cutout or relieved area 125 is in place to mate with the aforementioned feature 115 (FIG. 3). When the gear 124 is in the unlocked position (FIG. 6), the gear 124 presents a flat surface; as a result it is not possible to close the door 104.

Figure 7A:
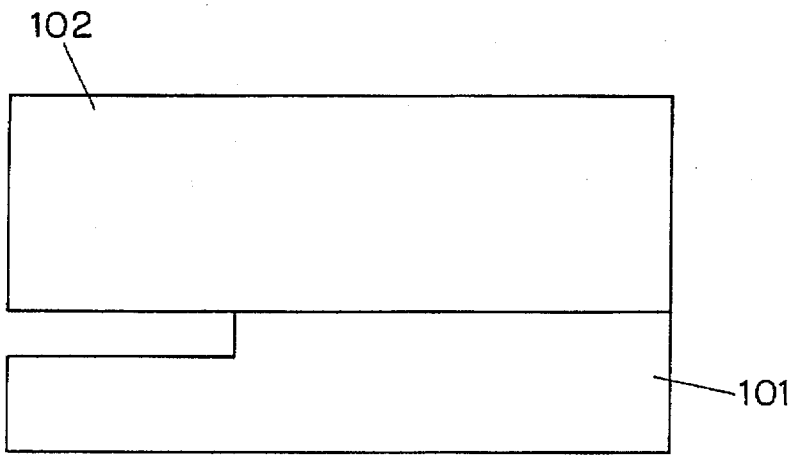
FIGS. 7(*a*), 7(*b*), and 7(*c*) are side views of a postage meter showing the top cover being removed.
Figure 7B:
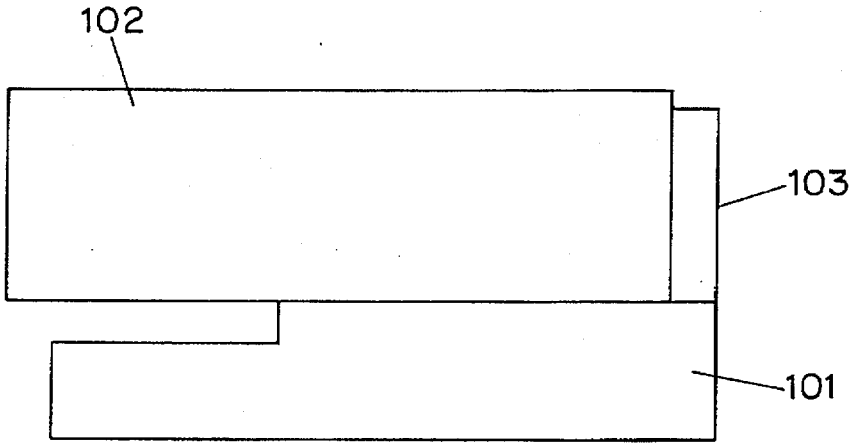
Figure 7C:
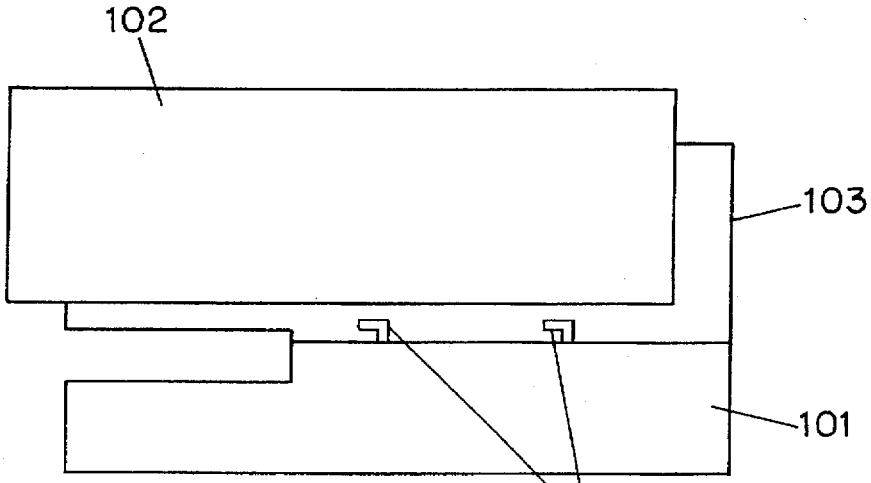

Turning now to FIGS. 7(*a*), 7(*b*), and 7(*c*), what is shown is the sequence of events as the top cover 102 is removed. Most of the time the meter is in the configuration of FIG. 7(*a*). Locking wedges, not visible in FIG. 7(*a*), secure the cover 102 against lateral movement. If the locking wedges are moved into a non-locking position (by rotation of the aforementioned gear 124 (FIG. 6), then it becomes possible to slide the top cover 102 to the front of the meter (to the left in FIG. 7(*b*)) as shown in FIG. 7(*b*). This makes it possible to see part of the rear panel 103. After cover 102 has moved forward sufficiently, L-shaped features 109 in the base 101 and corresponding features in the cover 102 come out of engagement, permitting the cover 102 to move upwards as shown in FIG. 7(*c*). With the cover 102 removed, it becomes possible to disassemble the meter to any desired extent.

FIG. 8 is a perspective view of the above-mentioned locking wedges 137, as seen from the upper front right corner of the postage meter. The front side of gear 124 may be seen, the rear of which was seen in FIGS. 5 and 6. Wedges 137 are at respective ends of sliders 119, 120. Sliders 119 and 120 are spring-loaded by spring 121, tending to pull wedges 137 toward each other. Spring 121 hooks to holes 155, 156. Sliders 119, 120 slide within holding slots in the internal chassis of the postage meter, and are held in their path by screw 122 and washer 123, which pass through slots 158, 159. Gear 124 has teeth 157 on its front face, which teeth engage racks 153, 154. As a result, rotation of gear 124 counterclockwise causes slider 120 to move to the right, and slider 119 to move to the left, in FIG. 8. This spreads the wedges 137 and releases the cover 102. Rotation of gear 124 clockwise in FIG. 8 draws the wedges 137 together, securing the cover 102.

FIGS. 9, 10, 11, and 12 show front, side, and first and second perspective views, respectively, of the ferrule 117 of FIG. 3. FIGS. 13, and 14 are perspective views of a retaining spring 118 which will be described in connection with FIG. 21.

Figure 15:
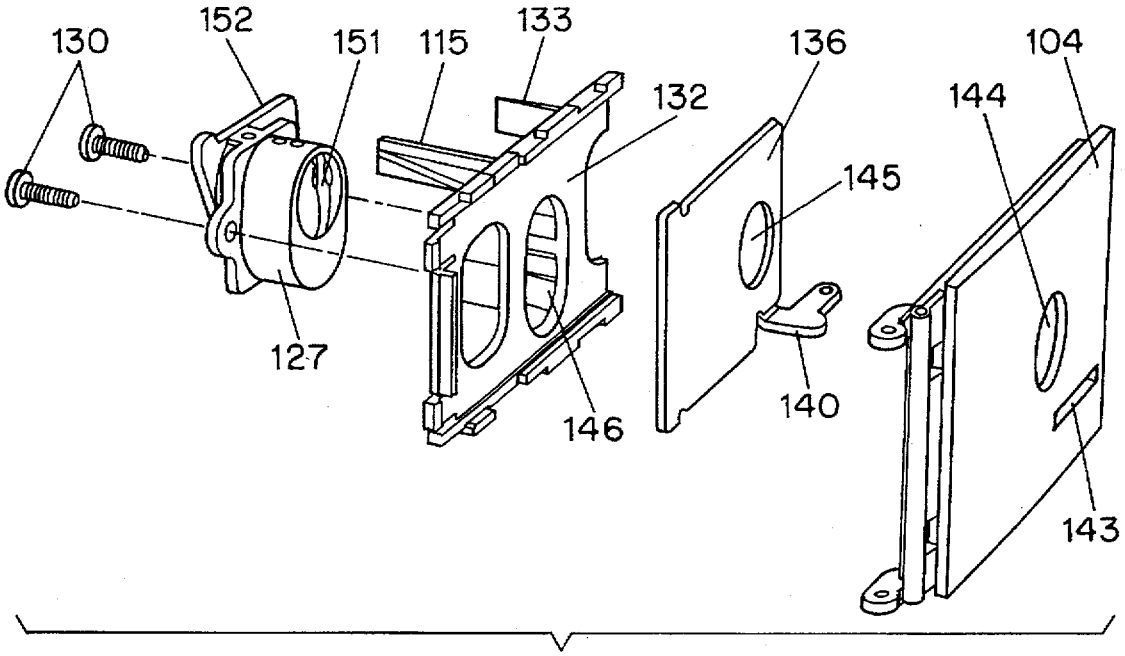
FIGS. 15 and 16 are exploded and perspective views of a lock-and-key embodiment of the invention.
Figure 16:
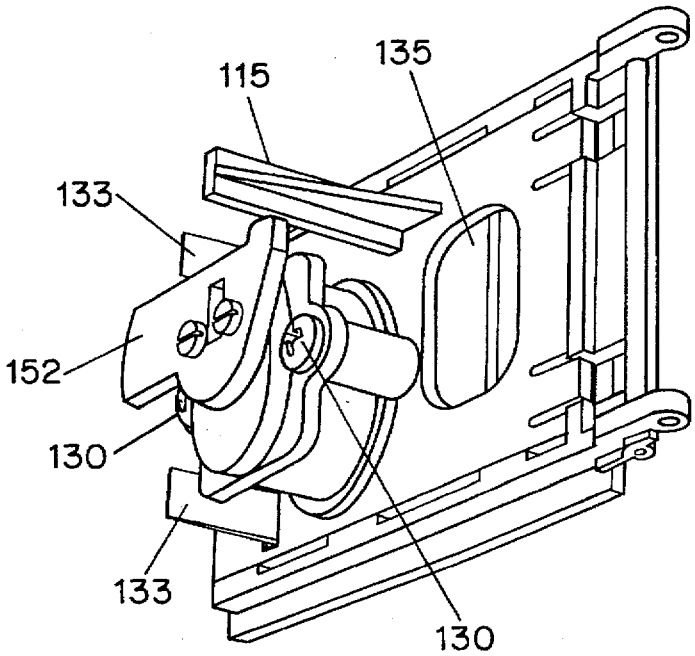

FIGS. 15 and 16 are exploded and perspective views of a lock-and-key embodiment of the invention. Door 104 may be seen. Rear piece 132 attaches to door 104 more or less permanently by snap-fit features. Captive between them is sliding metal panel 136 with tongue 140. When tongue 140 is wired into tie point 110 (FIG. 3) then hole 145 does not align with hole 144; it is not possible to reach the lock cylinder 127. If the panel 136 is slid away from tie point 110, then the hole 145 aligns with hole 144, permitting access to the cylinder 127. A postal key, not shown in FIG. 15, can then be inserted into the keyhole 151. Turning the key counterclockwise rotates the latch 152 counterclockwise, and thus out of engagement with feature 111 (FIG. 4). This permits opening the door 104.

Figure 17:
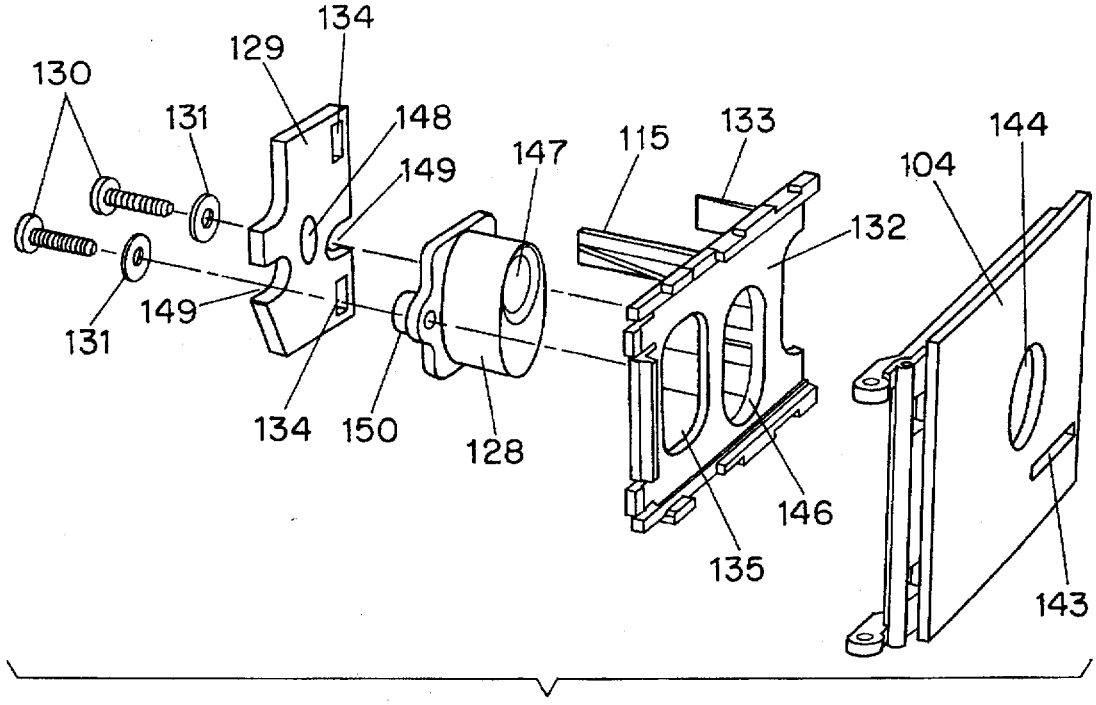
FIGS. 17 and 18 are exploded and perspective views of a paper-seal embodiment of the invention.
Figure 18:
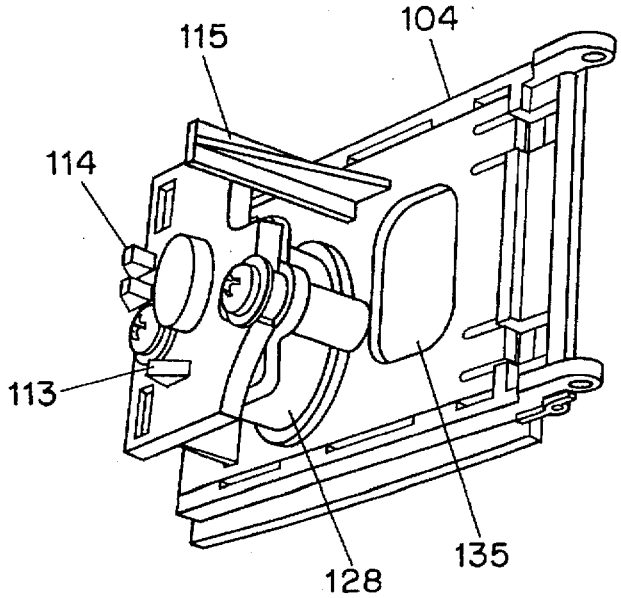

FIGS. 17 and 18 are exploded and perspective views of a paper-seal embodiment of the invention. Door 104 and rear piece 132 are identical to those shown in FIGS. 15 and 16.

Instead of lock cylinder 127, what is provided is dummy housing 128. This housing has an opening 147 that permits access to hole 148. When the door 104 is open it is possible to slide a paper seal into the space between the door 104 and the rear piece 132. (This may also be seen in FIG. 24.) When the door is closed, the paper seal blocks access through hole 144, and thus blocks access to hole 148. Latch 129 is movable to the left and right in FIG. 17, but is spring-loaded toward the right. As will be discussed below, latch 129 thus tends to engage latch feature 111 (FIG. 4). Latch 129 slides back and forth on guides 150 and is held by screws 130. Thin plastic features 133 act as springs, fitting into holes 134, and bring about the above-mentioned spring-loading to the right in FIG. 17. In FIG. 18 it is possible to see latch feature 114 which engages the aforementioned latch feature 111. Release latch 113 is also visible and will be discussed later. The mechanical result of the features just described is that the door is held shut by latch features 114 and 111. To open the door, it is necessary to puncture the paper seal 141 (FIG. 24) by a pointed object such as a screwdriver, through hole 144. Then it is possible for the screwdriver to pass through holes 146 and 147 to hole 148. Angling the screwdriver handle to the right (in FIG. 17) moves the screwdriver tip to the left, drawing the hole 148 to the left and drawing feature 114 (FIG. 18) out from behind feature 111 (FIG. 4). Release feature 113 then catches pawl 112 (FIG. 4) which holds the slider 129 to the left in FIG. 17. Pawl 112 also tends to push the door 104 open. Door 104 opens in response to pawl 112.

Figure 19:
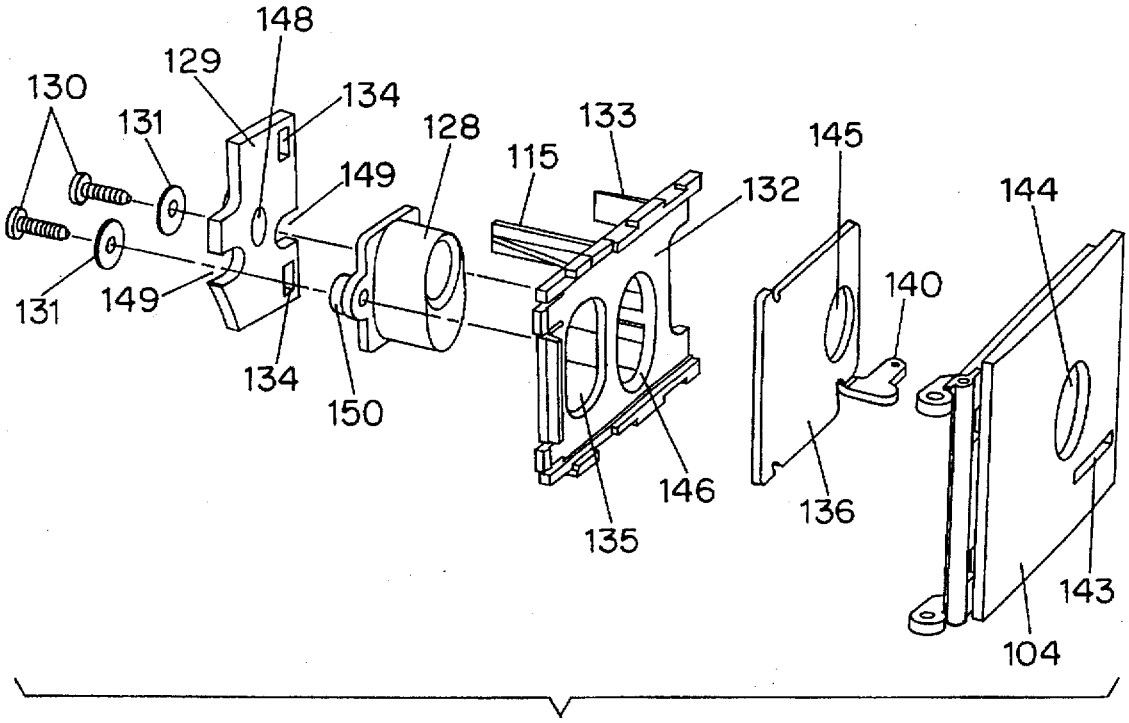
FIGS. 19 and 20 are exploded and perspective views of a lead-seal embodiment of the invention.
Figure 20:
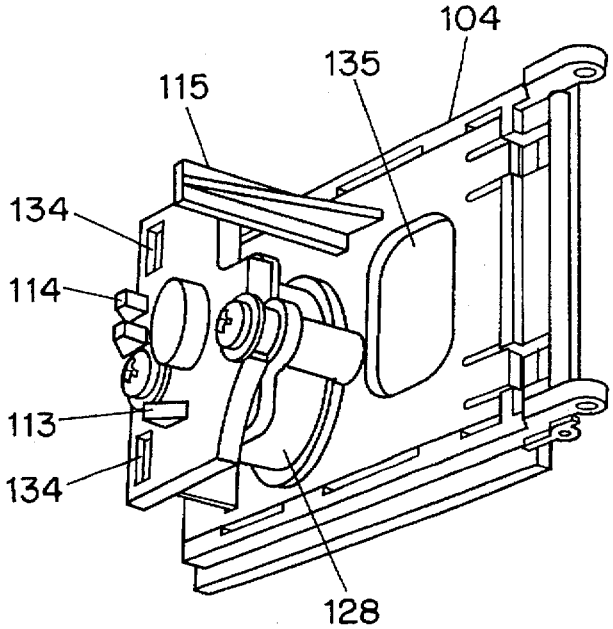

FIGS. 19 and 20 are exploded and perspective views of a lead-seal embodiment of the invention. Most of the mechanical configuration is the same as in FIGS. 17 and 18, except that metal plate 136 is present. This permits the door to be locked with the tongue 140 in the tie point 110 and wired in place with a lead seal. Optionally, a paper seal can also be provided between the door 104 and the plate 136, or between the plate 136 and the rear piece 132. The procedure for opening and closing the door is as described in connection with FIGS. 17 and 18 except that the plate 136 must be slid back and forth as described in connection with FIGS. 15 and 16.

Figure 21:
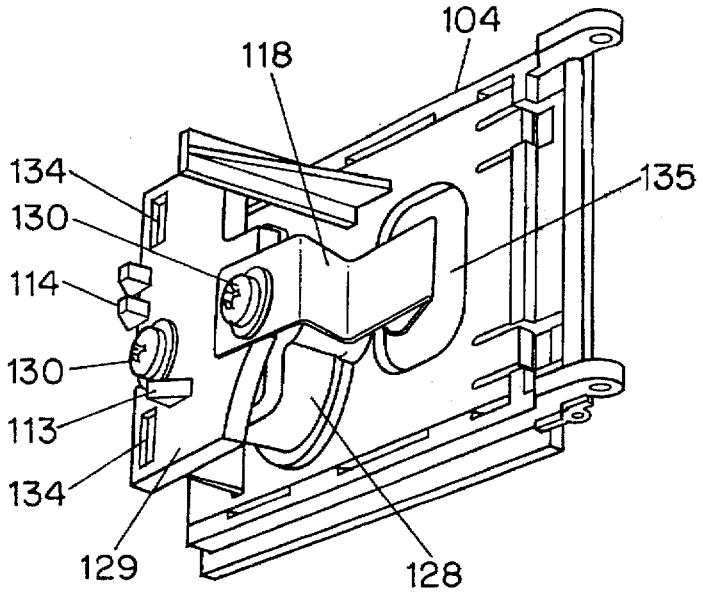
FIG. 21 is a perspective view of an embodiment of the invention showing a retaining spring.

FIG. 21 is a perspective view of an embodiment of the invention showing a retaining spring 118. Spring 118 is shown in detail in the aforementioned FIGS. 13 and 14, and is made of springy steel. It is held by one of screws 130 and enters hole 135, to provide a way of fixing a paper seal 141 (FIG. 24) from sliding about.

Figure 32:
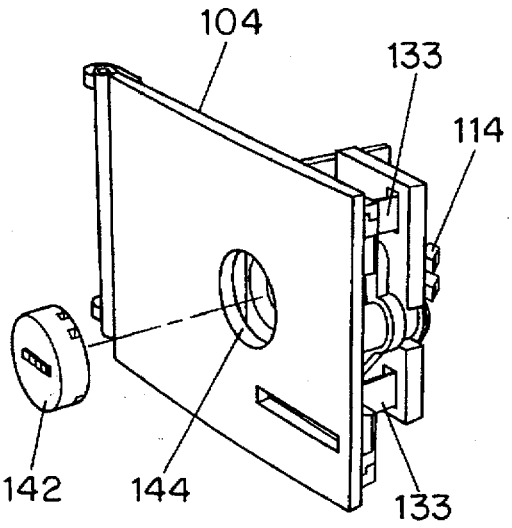
FIGS. 32, 33 and 34 show in first and second perspective views, and in cross section, a plastic-plug embodiment of the invention.
Figure 33:
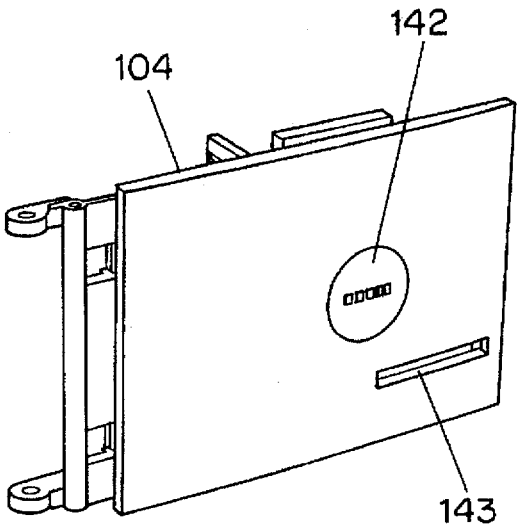
Figure 34:
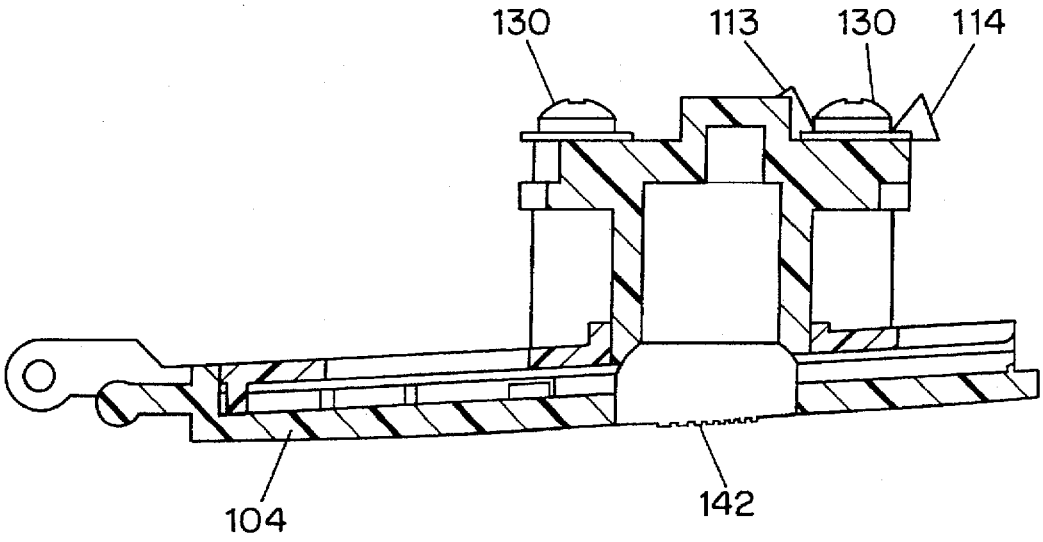

Turning now to FIGS. 32, 33 and 34, what is shown is a plastic-plug embodiment of the invention. A plastic plug 142 is inserted into the door 104. Small teeth on the periphery of the plug make it impossible to pull the plug out except by damaging the plug. The plug 142 is designed to fit flush with the front of the door 104, as shown in FIG. 34.

Figure 22:
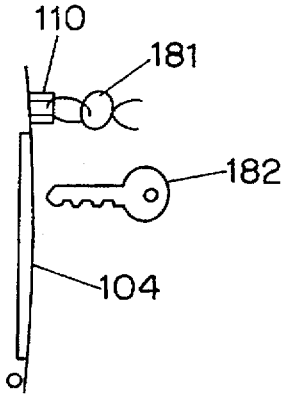
FIGS. 22, 23, 24, and 25 show in symbolic form the manner in which authorized postal personnel gain access to the postage meter according to the invention.

Turning now to FIGS. 22, 23, 24, and 25, what is shown in symbolic form is the manner in which authorized postal personnel gain access to the postage meter according to the invention. In FIG. 22 an authorized person cuts off the lead seal 181, slides the tongue away from the tie point 110, inserts the key 182, turns the key, and opens the door 104. To lock the meter, the door is pushed closed, the tongue is slid into the tie point 110, a wire is passed through the tongue and tie point, and a wire seal is crimped into place.

Figure 23:
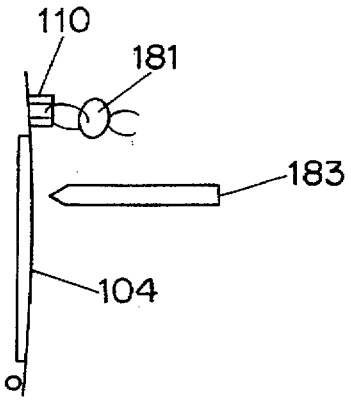

In FIG. 23 an authorized person cuts off the lead seal 181, slides the tongue away from the tie point 110, inserts a screwdriver or other pointed object 183, manipulates the object counterclockwise in FIG. 23, and opens the door 104. To lock the meter, the door is pushed closed, the tongue is slid into the tie point 110, a wire is passed through the tongue and tie point, and a wire seal is crimped into place.

Figure 24:
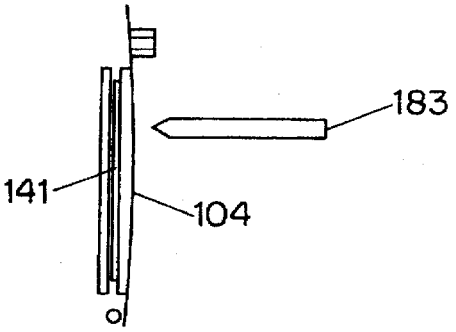

In FIG. 24 an authorized person punctures the paper seal 141, inserts a screwdriver or other pointed object 183, manipulates the object counterclockwise in FIG. 23, and opens the door 104. The old paper seal is removed from the door. To lock the meter, a new paper seal is slid into the door, and the door is pushed closed.

A hybrid arrangement of FIGS. 23 and 24 may also be employed. In that arrangement, an authorized person cuts off the lead seal 181, slides the tongue away from the tie point 110, inserts a screwdriver or other pointed object 183 thereby puncturing the paper seal 141, manipulates the object counterclockwise in FIG. 23, and opens the door 104. The old paper seal is removed from the door. To lock the meter, a new paper seal is slid into the door, the door is pushed closed, the tongue is slid into the tie point 110, a wire is passed through the tongue and tie point, and a wire seal is crimped into place.

Figure 25:
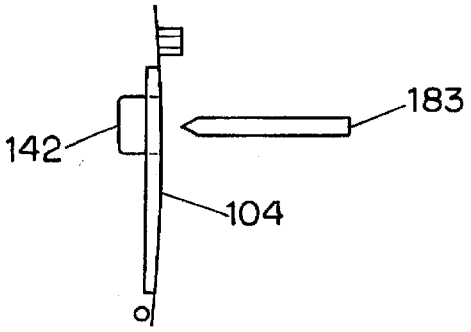
Figure 26:
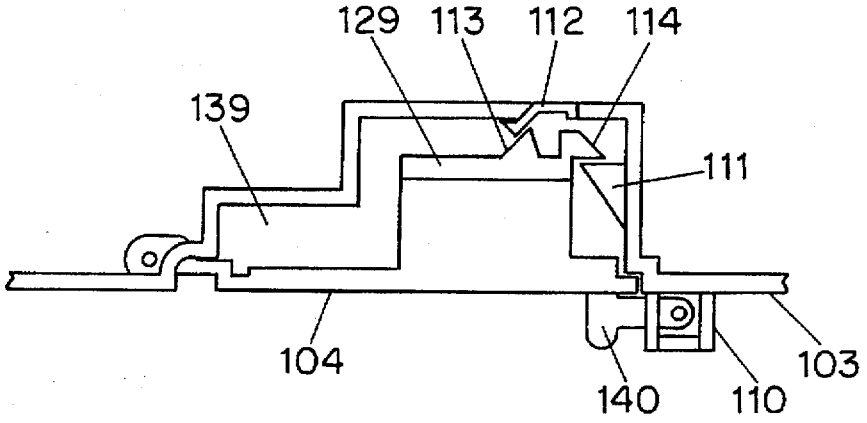
FIGS. 26, 27, 28, 29, 30 and 31 show in cross section the steps that take place as the postal lock according to the invention is opened and closed.
Figure 27:
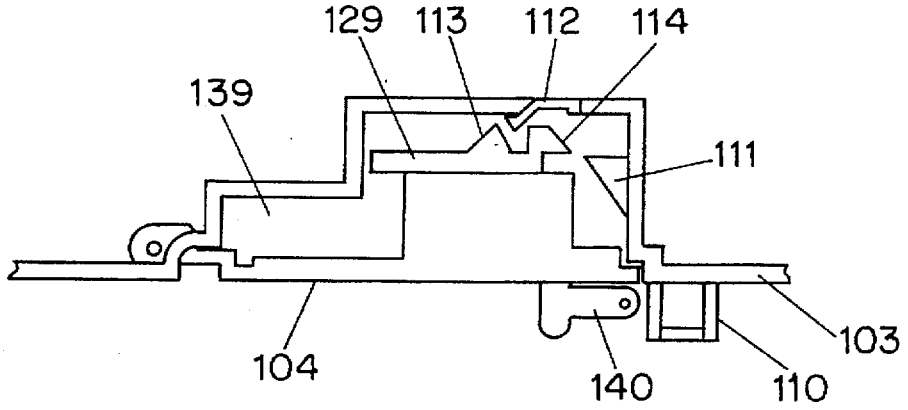

In FIG. 25 an authorized person punctures and removes the plastic plug 142, inserts a screwdriver or other pointed object 183, manipulates the object counterclockwise in FIG. 23, and opens the door 104. To lock the meter, a new plastic plug is inserted into the hole in the door, and the door is pushed closed.

Figure 28:
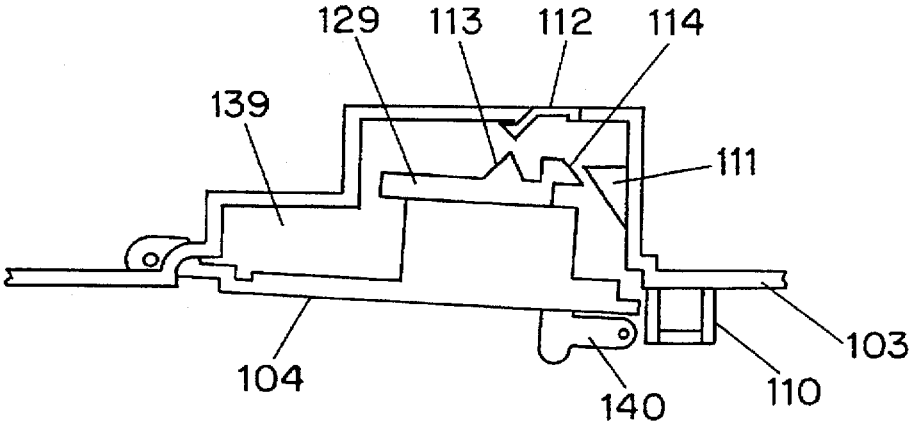

FIGS. 26, 27, 28, 29, 30 and 31 show in cross section the steps that take place as the postal lock according to the invention is opened and closed. Starting with FIG. 26, this shows the state of affairs most of the time, when the meter is in normal operation. Latch feature 114 engages feature 111, holding the door 104 shut. Tongue 140, if present, is slid rightwards into tie point 110 and is wired into place with a crimped lead seal. To open the door, the lead seal and wire are cut off, and tongue 140 is slid leftwards. Object 183 is inserted and slider 129 is moved slightly to the left in FIG. 27. This permits feature 113 to slide to the left of pawl 112. This blocks leftward movement of the slider 129, so that feature 114 remains clear of latch 111, and instead tends to rotate door 104 outwards from cavity 139. Feature 114 then bears slidingly on the tapered front of latch 111, as shown in FIG. 28, further tending to rotate door 104 outwards from cavity 139. The door opens.

Figure 29:
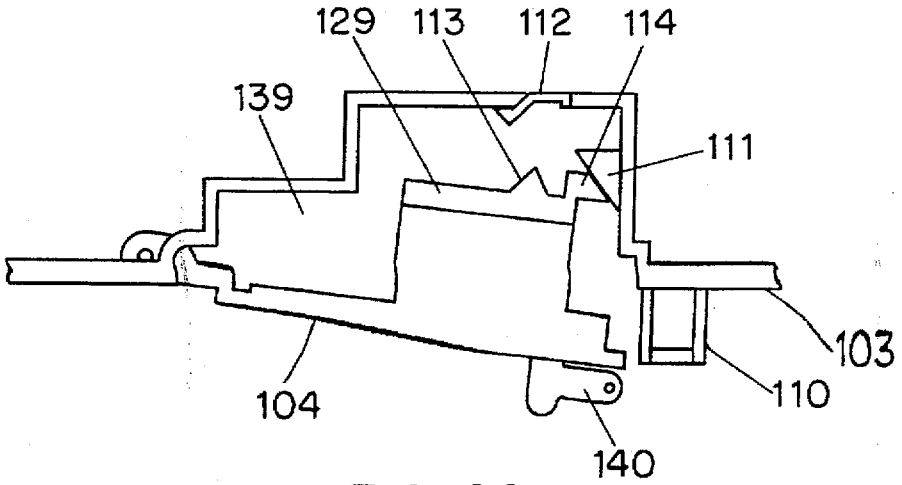
Figure 30:
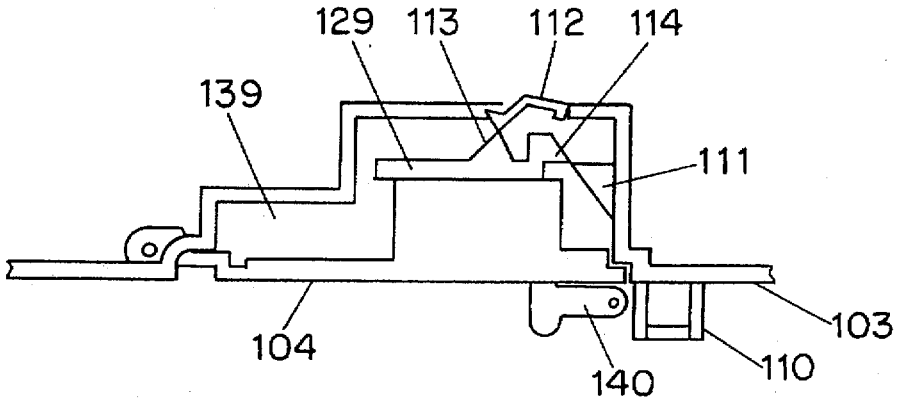
Figure 31:
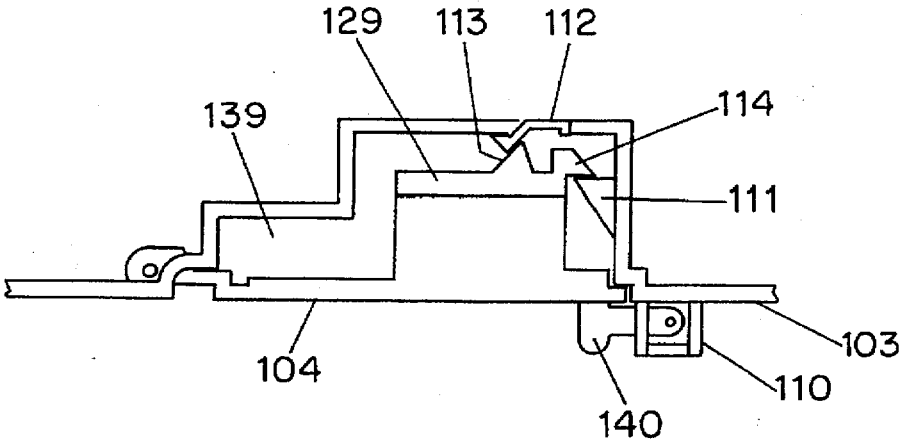

Closing the door is simple. The feature 114, shown in FIG. 29, is in sliding engagement with tapered front of feature 111. When feature 114 just clears the tip of feature 111, shown in FIG. 30, the release feature 113 does not quite clear pawl 112. Then the door 104 is permitted to close completely, as shown in FIG. 31, and the slider 129 moves fully rightwards, urged in that direction by springy features 133, not visible in FIG. 31.

In some countries the paper seal may be augmented with a clear plastic sheet that is placed in front of the paper seal. In some countries the door 104 may be made of transparent plastic, while in other countries it may be opaque, preferably of a color to match the rear panel 103.

The entire sequence of events when the case is to be opened thus comprises the following steps: open the postal door (by a procedure that differs depending on whether the lead seal, paper seal, or key lock is used), rotate the gear 124 clockwise, slide the top cover toward the front of the meter, and lift it upwards. To close the cover, lower it into place, slide it toward the rear of the meter into place, rotate the gear 124 counterclockwise, and close the cover.

Those skilled in the art will appreciate that what has been described is a postage meter with a secure housing, having a relatively simple postal locking mechanism that is the same in all countries, that does not take up too much volume.

While the above-described invention has been described with respect to particular embodiments, the invention is not limited to those particular embodiments. Those skilled in the art will have no difficulty devising numerous and diverse obvious variations of the invention, defined by the claims that follow. For example, the latch feature and release pawl of the housing are disclosed as being integrally formed with the housing of the meter, but could be fabricated separately and assembled thereto. The spring feature of the cover piece is disclosed as integrally formed therewith but could likewise be fabricated separately and assembled thereto.

I claim:

1. A postage meter having a secure housing and a printing means and accounting register within the secure housing, the secure housing further comprising a postal lock, the postal lock comprising:

a door movable between first and second positions, the door in said first position rendering a cavity inaccessible and in said second position rendering the cavity accessible; said door comprising a latch movable between first and second positions, said latch in said first position engaging a first feature in the housing whereby the door is held in its first position, said latch in said second position engaging a second feature in the housing, said second feature disposed to urge said door toward its second position.

2. The meter according to claim 1 wherein the secure housing further comprises first and second portions separable from each other, and wherein said door has a protruberance extending into said cavity;

said postal lock further comprising an actuator within said cavity movable between first and second positions, said actuator in said first position preventing separation of the first and second portions, and said actuator in said second position permitting separation of the first and second portions, said actuator engageable with said protruberance such that said actuator in said second position prevents moving the door into the first position.

3. The meter according to claim 2 wherein the actuator rotates between said first and second positions, the engagement between the actuator and the protuberance being by means of an axial cam on the actuator.

4. A postage meter having a secure housing and a printing means and accounting register within the secure housing, the secure housing further comprising first and second portions separable from each other; the secure housing further comprising a postal lock, the postal lock comprising:

a door movable between first and second positions, the door in said first position rendering a cavity inaccessible and in said second position rendering the cavity accessible, said door having a protruberance extending into said cavity;

said postal lock further comprising an actuator within said cavity movable between first and second positions, said actuator in said first position preventing separation of the first and second portions, and said actuator in said second position permitting separation of the first and second portions, said actuator engageable with said protruberance such that said actuator in said second position prevents moving the door into the first position.

5. The meter according to claim 4 wherein the actuator rotates between said first and second positions, the engagement between the actuator and the protuberance being by means of an axial cam on the actuator.

* * * * *